US006716069B2

(12) United States Patent
Nakamura et al.

(10) Patent No.: US 6,716,069 B2
(45) Date of Patent: Apr. 6, 2004

(54) CONNECTOR WITH A HOUSING AND A RETAINER HELD SECURELY ON THE HOUSING

(75) Inventors: Hideto Nakamura, Yokkaichi (JP); Takeshi Tsuji, Yokkaichi (JP); Ryotaro Ishikawa, Yokkaichi (JP); Hajime Kawase, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/176,262

(22) Filed: Jun. 19, 2002

(65) Prior Publication Data

US 2002/0193014 A1 Dec. 19, 2002

(30) Foreign Application Priority Data

Jun. 19, 2001 (JP) ..... 2001-184851

(51) Int. Cl.[7] ..... H01R 13/514; H01R 13/40
(52) U.S. Cl. ..... 439/752; 439/595
(58) Field of Search ..... 439/752, 595, 439/603, 357, 304

(56) References Cited

U.S. PATENT DOCUMENTS 5,098,315 A * 3/1992 Scowen ..... 439/587
5,209,676 A 5/1993 Endo et al.
5,326,287 A * 7/1994 Hamakita et al. ..... 439/752
5,378,176 A 1/1995 Sasai ..... 439/752
5,437,565 A 8/1995 Atsumi et al.
5,464,356 A 11/1995 Nebeshima et al.
5,643,015 A * 7/1997 Wakata ..... 439/701
5,651,703 A 7/1997 Sasai
5,674,096 A 10/1997 Duclos et al.
5,928,034 A 7/1999 Tabata et al.
6,053,753 A * 4/2000 Kunkle ..... 439/275
6,080,023 A 6/2000 Meulemeester et al.
6,280,234 B1 8/2001 Yamamoto et al.

FOREIGN PATENT DOCUMENTS

EP 0 945 925 9/1999

* cited by examiner

*Primary Examiner*—Chandrika Prasad
(74) *Attorney, Agent, or Firm*—Anthony J. Casella; Gerald E. Hespos

(57) ABSTRACT

A connector has a housing (20) and a retainer (40) with a pair of side pieces (42). The side pieces (42) are fitted into retainer mount recesses (31) in the opposite side surfaces of the housing (20). Dovetail grooves (34) and dovetail projections (46) are provided between the side pieces (42) of the retainer (40) and the housing (20). Thus, disengagement of the side pieces (42) from the retainer mount recesses (31) can be prevented, thereby preventing the retainer (40) from being detached from the housing (20) while operating the retainer (40).

11 Claims, 12 Drawing Sheets

CONNECTOR WITH A HOUSING AND A RETAINER HELD SECURELY ON THE HOUSING

BACKGROUND OF THE INVENTION

1. Field of the Invention

The present invention relates to a connector provided with a retainer.

2. Description of the Related Art

U.S. Pat. No. 5,378,176 discloses a connector with a housing and cavities formed in the housing. A substantially gate-shaped retainer is provided for locking terminal fittings in the cavities. The gate-shaped retainer has two side pieces that hold the housing between the side pieces while the respective side pieces are fit into retainer mount recesses in opposite side surfaces of the housing. The retainer is slidable between a partial locking position where insertion of the terminal fittings into the cavities is permitted and a full locking position where the terminal fittings are held at proper insertion positions. The retainer is held at these positions by engaging projections on the side surfaces of the housing where the retainer mount recesses are formed.

In recent years, there has been a demand to make connectors smaller. Connectors as described above are sometimes made smaller along the width direction by reducing the thickness of the side pieces of the retainer and that of the side walls of the connector housing. However, this results in smaller engaging areas of the side pieces and the retainer mount recesses. Thus, the side pieces may mistakenly disengage from the retainer mount recesses and the retainer may detach from the housing, for example, when the side pieces move onto the projections during the sliding movement of the retainer.

In view of the above problem, an object of the invention is to provide a connector in which disengagement of a retainer from a housing is prevented.

SUMMARY OF THE INVENTION

The invention is directed to a connector with a housing that has opposite front and rear ends. Cavities are arranged transversely in the housing and preferably extend through the housing from the front end to the rear end. The housing also is formed with two retainer mount recesses that preferably are in opposite side surfaces of the housing. The connector also includes a retainer with a pair of retainer pieces. The retainer is mounted to the housing by fitting the retainer pieces into the retainer mount recesses. The retainer can slide from a first position where insertion of terminal fittings into the cavities is permitted to a second position where the terminal fittings are held in the respective cavity. An open-stopping means is provided between the retainer pieces and the housing for preventing an opening deformation of the retainer pieces that would widen a spacing therebetween more than a specified amount.

Accordingly, an opening deformation that would disengage the retainer pieces from the retainer mount recesses can be prevented, thereby preventing the retainer from being detached from the connector housing, for example, when the retainer is operated.

Preferably, the retainer is substantially gate-shaped, and the retainer pieces are defined by a pair of side pieces.

The retainer preferably is mountable to hold the housing between the retainer pieces by fitting the retainer pieces into the retainer mount recesses.

The open-stopping means preferably comprises grooves in one of the housing and the retainer side pieces along a sliding direction of the retainer, and engaging projections on the other of retainer side pieces and the housing substantially along the sliding direction. The engaging projections engage slideably in the grooves to ensure a smooth operation.

The groove preferably is a dovetail groove and/or the engaging projection comprises a dovetail projection.

Each cavity preferably comprises a resiliently deformable lock with a locking section that is engageable with the corresponding terminal fitting. The retainer preferably comprises a deformation preventing portion for entering deformation permitting spaces for the locks when the retainer is at the second position to prevent the resilient deformation of the locks. Accordingly, the terminal fittings are locked doubly by moving the retainer to the second position.

Each lock extends substantially along an inserting direction of the terminal fittings and preferably has a substantially L-shaped cross section extending along an arranging direction of the cavities and a direction normal to the arranging direction.

The lock preferably is formed to be deformed obliquely at an angle to the insertion direction of the terminal fittings and/or a transverse direction of the housing when contacted by the corresponding terminal fitting.

Accordingly, since each lock has the L-shaped cross section and/or is deformable in a direction oblique to the arranging direction of the cavities, dimensions of a necessary deformation permitting space along the vertical and horizontal directions of the housing can be smaller than an amount of resilient deformation of the lock in its deforming direction. Thus, the connector can be made smaller by reducing an arrangement interval of the cavities while ensuring sufficient locking forces for locking the terminal fittings.

These and other objects, features and advantages of the present invention will become apparent upon reading of the following detailed description of preferred embodiments and accompanying drawings in which:

DETAILED DESCRIPTION OF THE PREFERRED EMBODIMENT

Figure 1:
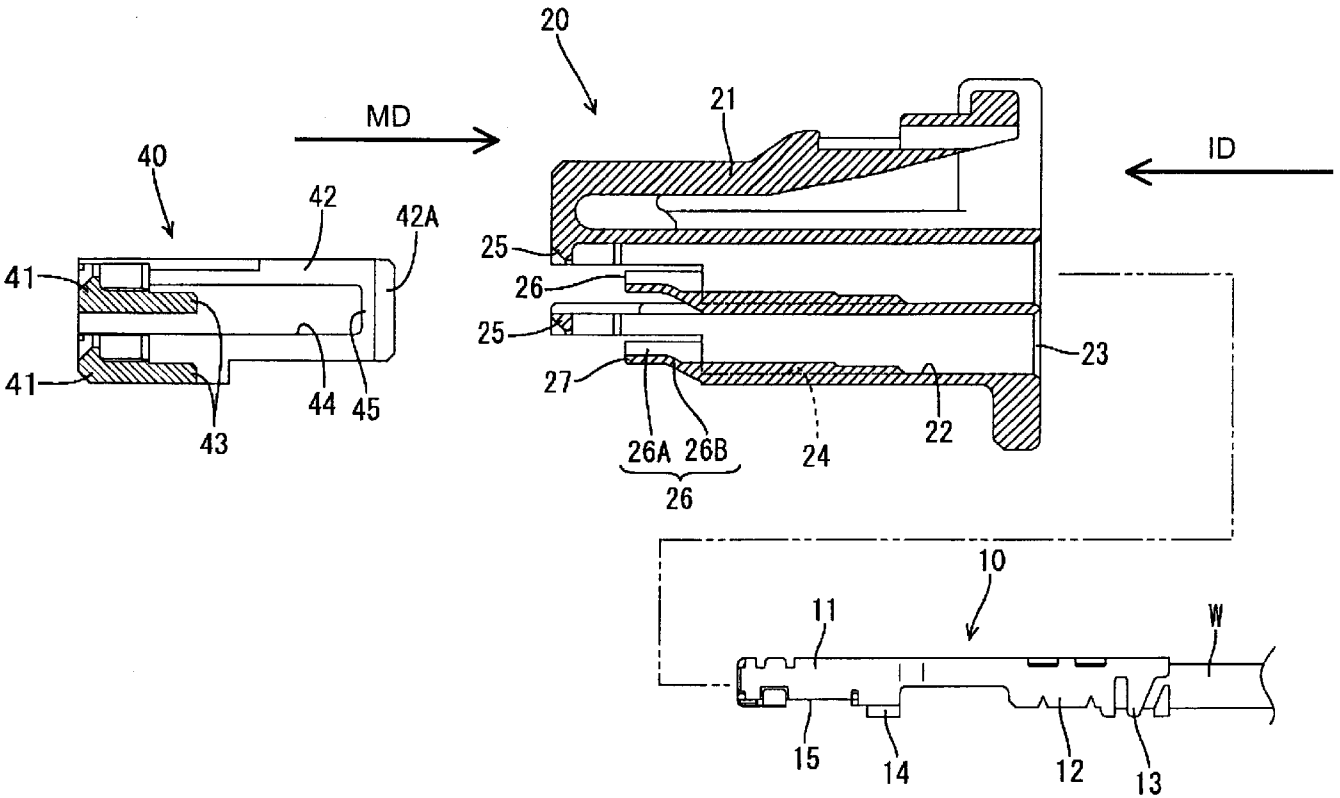
FIG. 1 is an exploded side view in section of a connector according to one embodiment of the invention.
Figure 2:
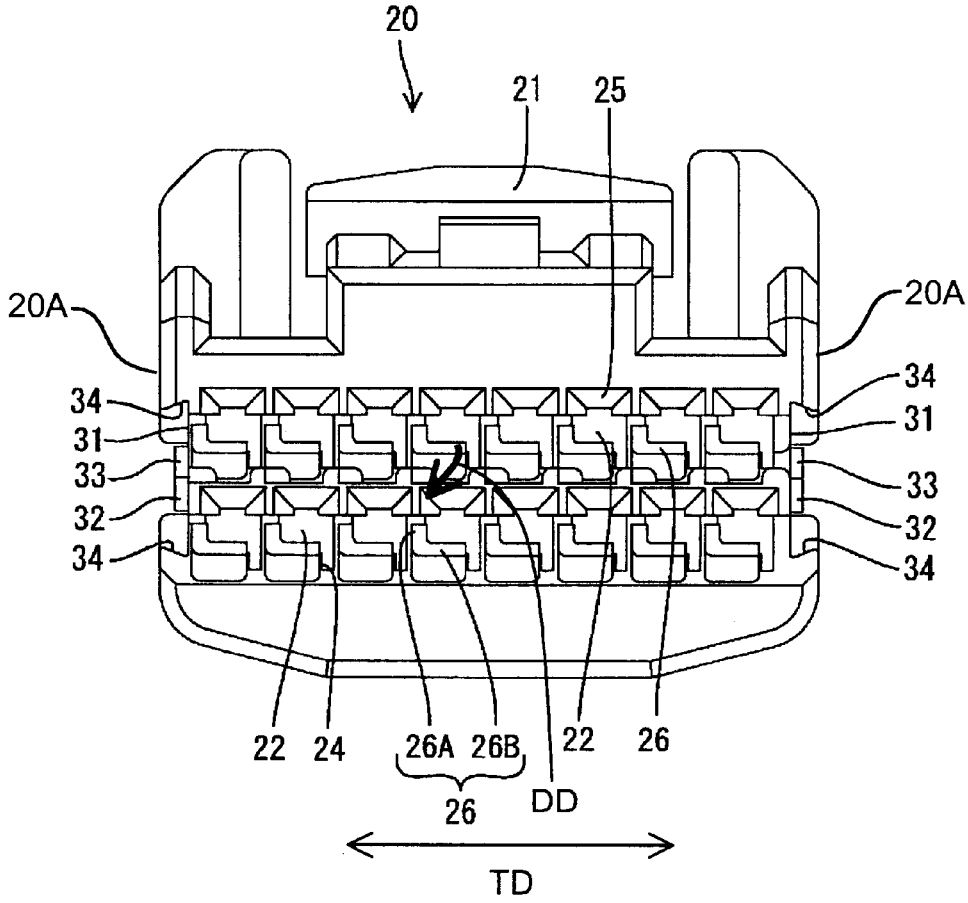
FIG. 2 is a front view of a connector housing.
Figure 3:
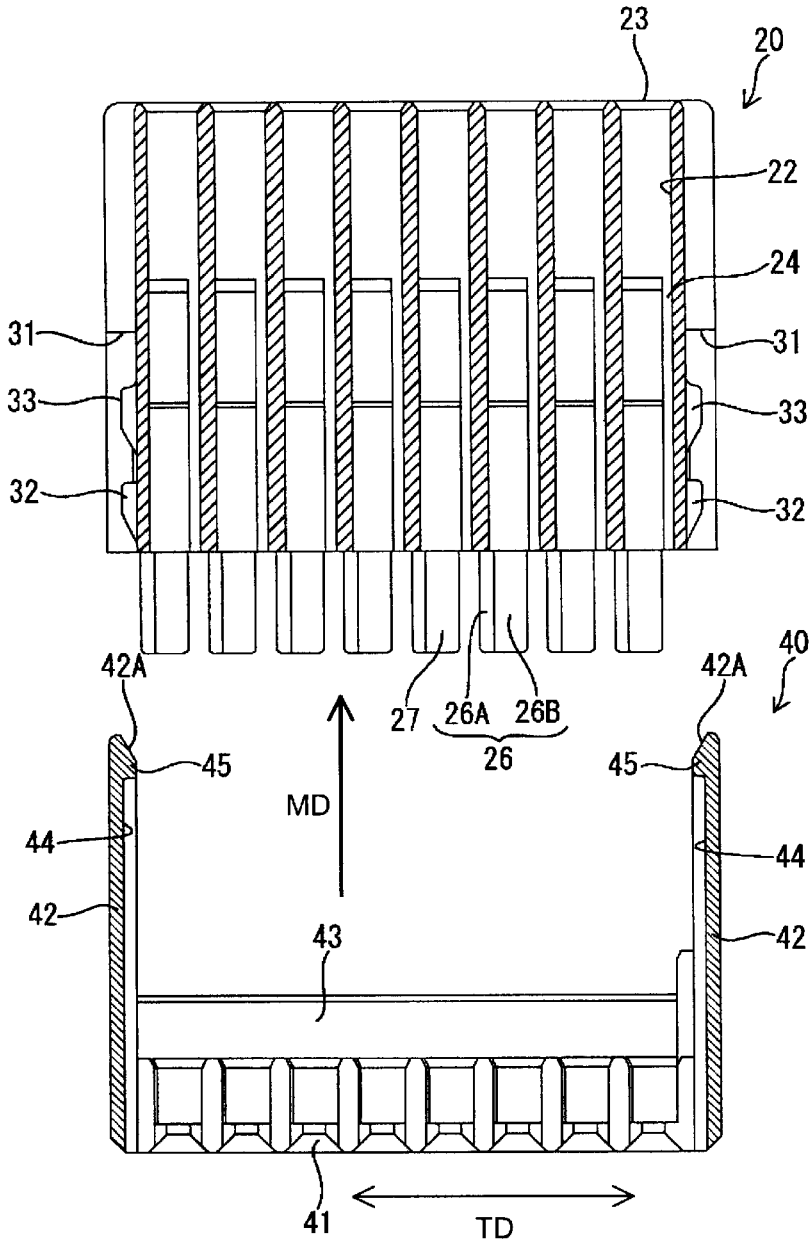
FIG. 3 is a plan view in section showing the connector housing and a retainer before the retainer is assembled with the connector housing.
Figure 4:
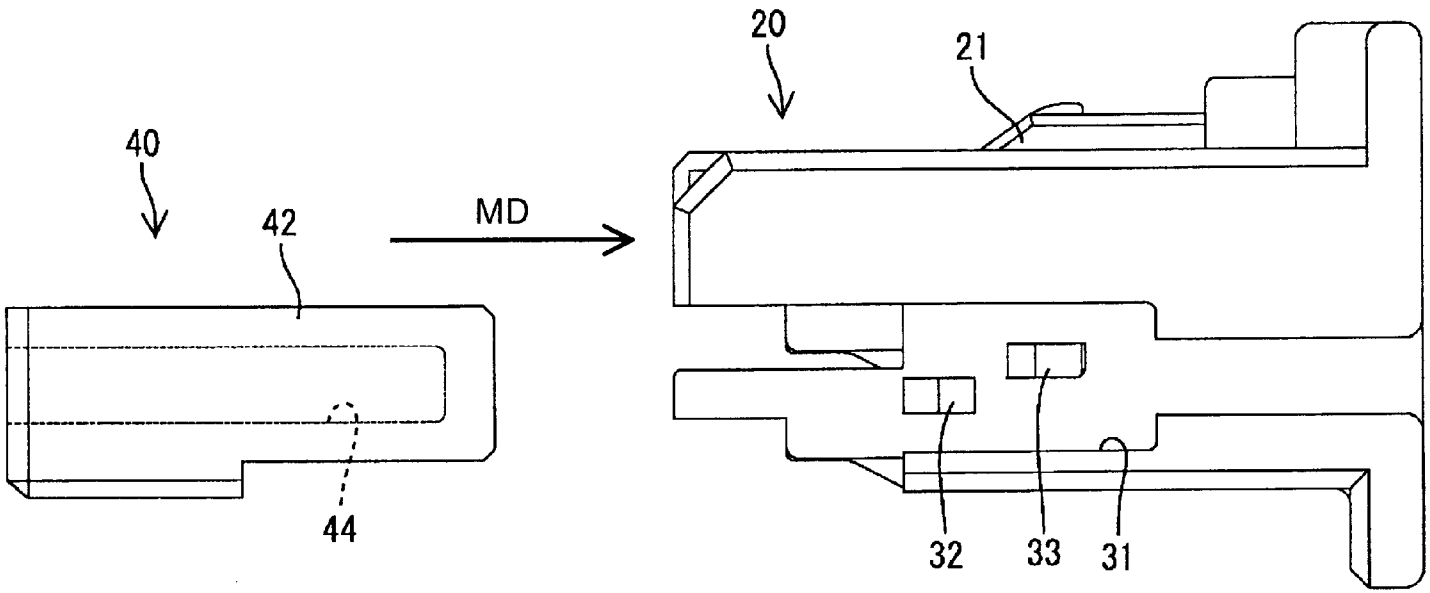
FIG. 4 is a side view of the connector housing and the retainer in the state of FIG. 3.
Figure 5:
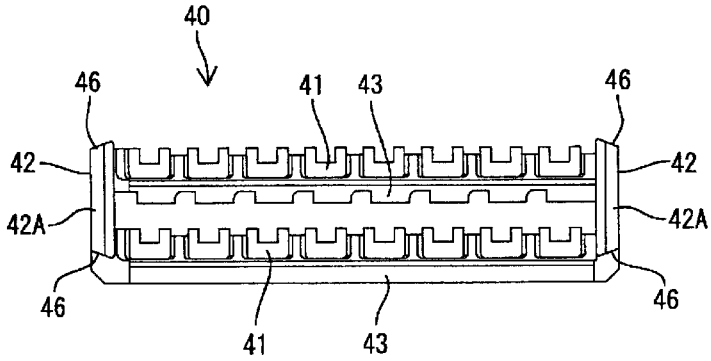
FIG. 5 is a rear view of the retainer.

A female connector according to the invention is illustrated in FIG. 1. The illustrated female connector includes a female housing 20 into which female terminal fittings 10 are insertable and a retainer 40 for doubly locking the female terminal fittings 10 in the housing 20. In the following description, the left side in FIG. 1 is the side of the female housing 20 that mates with the unillustrated male housing and is referred to as the front. Reference also is made to FIG. 1 concerning vertical direction.

Each female terminal fitting 10 is formed by bending, folding and/or embossing an electrically conductive metallic plate stamped or cut into a specified shape. As shown in FIG. 1, the front of the terminal fitting 10 is formed into a substantially rectangular tube 11 that can be connected with a male tab of a male terminal fitting. The rear of the terminal fitting 10 defines a crimping portion 12 for crimped connection with a core at an end of a wire W and a barrel 13 for crimped connection with an insulated portion of the wire W.

A resilient contact piece is formed inside the rectangular tube 11 and a male tab of a male terminal fitting can be inserted into the open front of the rectangular tube 11 for contacting the resilient contact piece and achieving electrical connection between the male terminal fitting and the female terminal fitting 10. A stabilizer 14 projects down from the bottom surface of the rectangular tube 11 at a right end position of the rear end when viewed from front for guiding the insertion of the female terminal fitting 10. A middle portion of the bottom surface of the rectangular tube 11 with respect to forward and backward directions forms a locking recess 15.

As shown in FIGS. 1 to 4, the female housing 20 is made e.g. of a synthetic resin and defines a substantially rectangular parallelepipedic shape. A lock arm 21 is on the upper surface of the female housing 20 for locking the female housing 20 into the male housing when the housings are connected properly. Cavities 22 are arranged transversely at each of upper and lower stages in the female housing 20, and terminal insertion openings 23 are formed at the rear ends of the respective cavities 22 to enable insertion of the female terminal fittings 10 along an insertion direction ID. A guide groove 24 extends along forward and backward directions at the right end of the bottom surface of each cavity 22 when viewed from front. The stabilizer 14 of the female terminal fitting 10 enters the guide groove 24 to stabilize the orientation of the female terminal fittings 10 that are inserted in the insertion direction ID. A substantially bottom half is opened at a front end of each cavity 22, and a front wall 25 is formed at a front end of the upper half of each cavity 22 for stopping the corresponding female terminal fitting 10 inserted into the cavity 22 at its front-limit position. The front wall 25 forms an upper half of an edge of a tab insertion opening through which the male tab of the male terminal fitting is insertable.

A lock 26 projects forward at a front part of each cavity 22 in a position slightly behind a portion of the cavity 22 that has its bottom half opened. The lock 26 is at a lower left corner of the cavity 22 and forms part of the wall surface of the cavity 22. Each lock 26 defines an L-shaped cross section with a side wall 26A and a bottom wall 26B. The bottom wall 26B bulges up at the leading end of the lock 26 to form a locking section 27 that enters the locking recess 15 of the corresponding female terminal fitting 10 to lock the female terminal fitting 10. The lock 26 is thin and a leading end of the lock 26 is resiliently deformable in an oblique direction DD (lower-left direction when viewed from front) substantially normal to the insertion direction ID and/or between 0° and 90° with respect to a transverse direction TD of the housing 20.

The retainer 40 is made e.g. of a synthetic resin and is substantially bridge- or gate-shaped, with spaced-apart upper and lower front walls 41 extending in a substantially transverse direction TD. The retainer 40 has side pieces 42 that extend back in a moving direction MD of the retainer 40 from opposite side ends of the front walls 41 as shown in FIGS. 1, 3 to 5. The retainer 40 is mountable from front on the female housing 20 to hold the female housing 20 between the side pieces 42 and to arrange the side pieces 42 on lateral surfaces 20A of the female housing 20. Thus, the side pieces 42 straddle the female housing 20. The front walls 41 of the retainer 40 cover the opened bottom halves at the fronts of the cavities 22 and substantially align with the front walls 25 to form the bottom halves of the tab insertion openings through which the male tabs are insertable. Transverse deformation preventing plates 43 project back from the bottom ends of the front walls 41, and enter deformation permitting spaces below the locking sections 27 of the locks 26 to prevent the resilient deformation of the locks 26 in the deformation direction DD away from the corresponding female terminal fitting 10.

The side pieces 42 have parallel surfaces and leading ends thereof are resiliently deformable in opening directions to widen the space therebetween. Long and narrow recesses 44 are formed in the inner surfaces of the side pieces 42 and extend in forward and backward directions. Lock projections 45 are formed at the leading ends of the side pieces 42 and project from the recesses 44. Further, a slanted surface 42A is inclined inwardly at the leading edge of each side piece 42.

Figure 10:
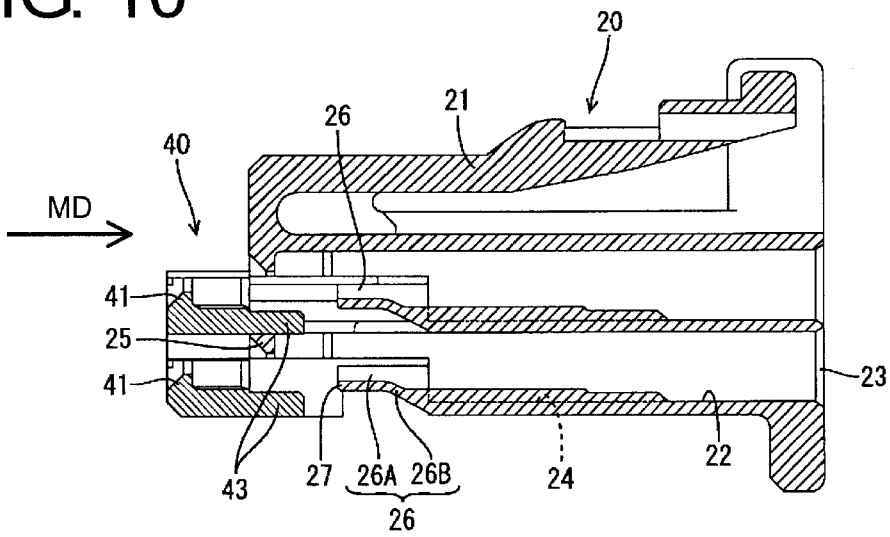
FIG. 10 is a side view in section showing the state of FIG. 8.
Figure 13:
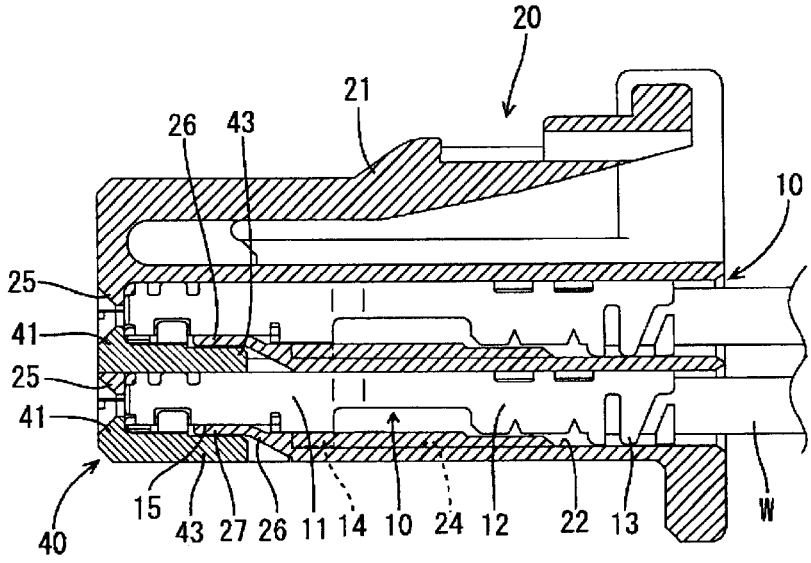
FIG. 13 is a side view in section showing the assembled connector.

Long narrow retainer mount recesses 31 extend in forward and backward directions in the opposite side surfaces 20A of the female housing 20, and the side pieces 42 of the retainer 40 are fittable into the mount recesses 31. The thickness of the side pieces 42 and the depth of the retainer mount recesses 31 are substantially equal, so that the side pieces 42 are substantially flush with the side surfaces 20A of the female housing 20 when the retainer 40 is assembled with the housing 20. The retainer 40 is slidable forward and backward with the side pieces 42 in the corresponding retainer mount recesses 31 between a full locking position (see FIG. 13) where the deformation preventing portions 43 are in the deformation permitting spaces below the locking sections 27 of the locks 26 and a partial locking position (see FIG. 10) where the deformation preventing portions 43 are forward from the full locking position to permit the resilient deformation of the locks 26. A partial locking projection 32 and a full locking projection 33 are on each side surface 20A of the female housing 20 where the retainer mount recesses 31 are formed while being displaced along forward and backward directions and a vertical direction. These projections 32, 33 have a moderately sloped front surface. With the projections 32, 33 fitted in the recesses 44 of the side pieces 42, the rear surfaces of the projections 32, 33 engage the lock projections 45 to position the retainer 40 selectively at the partial or full locking position.

Figure 7:
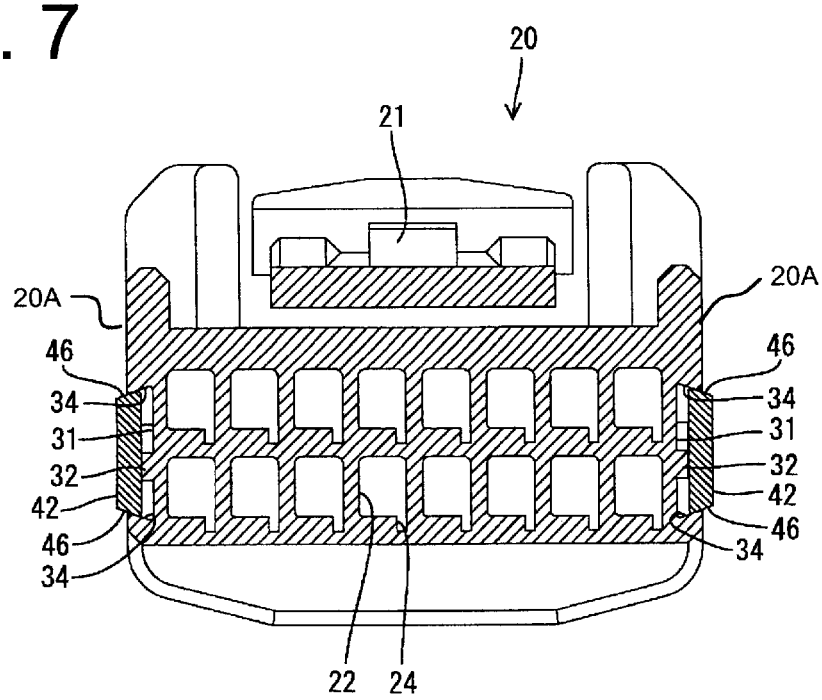
FIG. 7 is a front view in section showing the state of FIG. 6.

Forwardly open dovetail grooves 34 are formed at the upper and bottom edges of the retainer mount recesses 31 (see FIG. 2) and extend in forward and backward directions. Dovetail projections 46 (see FIG. 5) are provided at the upper and lower edges of the side pieces 42 of the retainer 40 and extend along forward and backward directions. The dovetail projections 46 fit in the corresponding dovetail grooves 34 and are movable in forward and backward directions. Play for permitting a specified degree of resilient deformation of the side pieces 42 in opening directions to widen the spacing therebetween are provided between the dovetail grooves 34 and the dovetail portions 46, as shown in FIG. 7.

The retainer 40 is mounted on the female housing 20 by moving the retainer 40 closer to the housing 20 from the front. Thus, the side pieces 42 fit into the retainer mount recesses 31 and the dovetail projections 46 engage the dovetail grooves 34. The retainer 40 is moved back in the mounting direction MD so that the side pieces 42 are slid back in the moving direction MD in the retainer mount recesses 31 and are guided by the dovetail grooves 34. Thus, the slanted surfaces 42A of the side pieces 42 contact the front surfaces of the partial locking projections 32.

Figure 6:
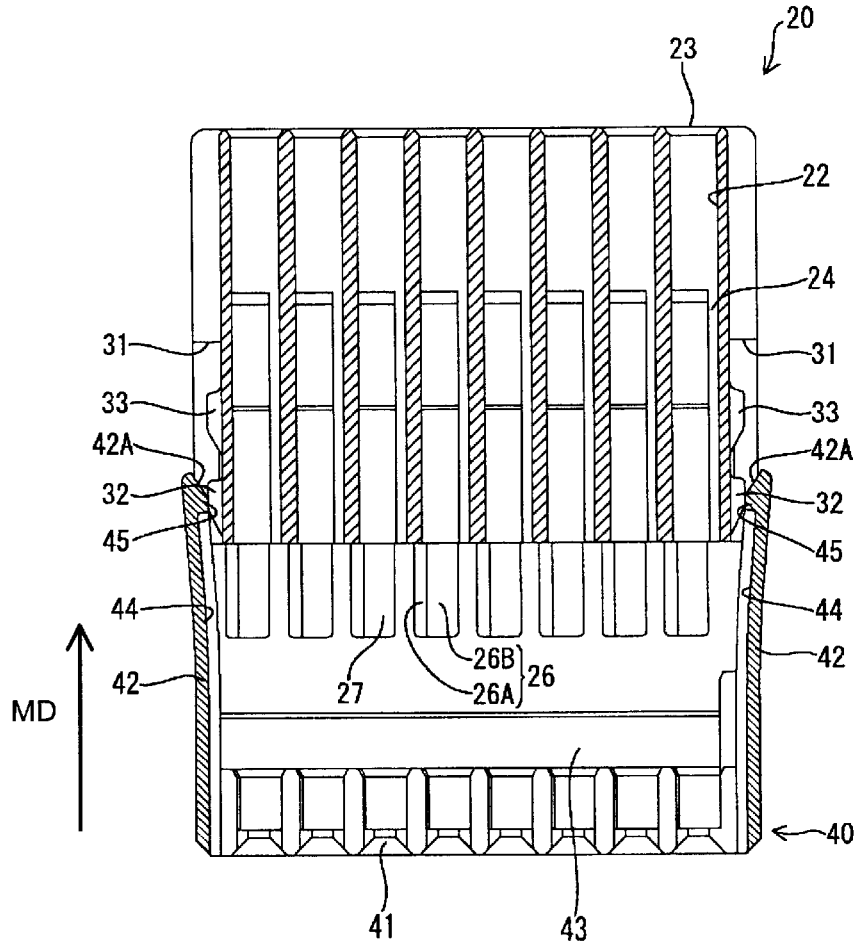
FIG. 6 is a plan view in section showing a state where side pieces of the retainer are moved onto partial locking projections.

When the retainer 40 is moved further back in the moving direction MD, the side pieces 42 deform resiliently in the opening directions to widen the space therebetween while being guided by the slanted surfaces 42A and the slanted surfaces of the partial locking projections 32. Thus, the lock projections 45 move onto the partial locking projections 32 (see FIGS. 6 and 7). In this state, the side pieces 42 are spaced apart from the bottom surfaces of the retainer mount recesses 31 and make the engaging areas of the side pieces 42 and the retainer mount recesses 31 smaller. However, the dovetail grooves 34 and the dovetail projections 46 are engaged. Thus, even if a vertical force is mistakenly exerted on the retainer 40 during the operation, the side pieces 42 will not disengage from the retainer mount recesses 31. In other words, the side pieces 42 undergo a resilient deformation to widen the distance therebetween sufficiently to allow the slanted surfaces 42A to pass over the partial locking projections 32 but not more than such specified amount due to the interaction of the dovetail grooves 36 with the dovetail projections 46.

Figure 8:
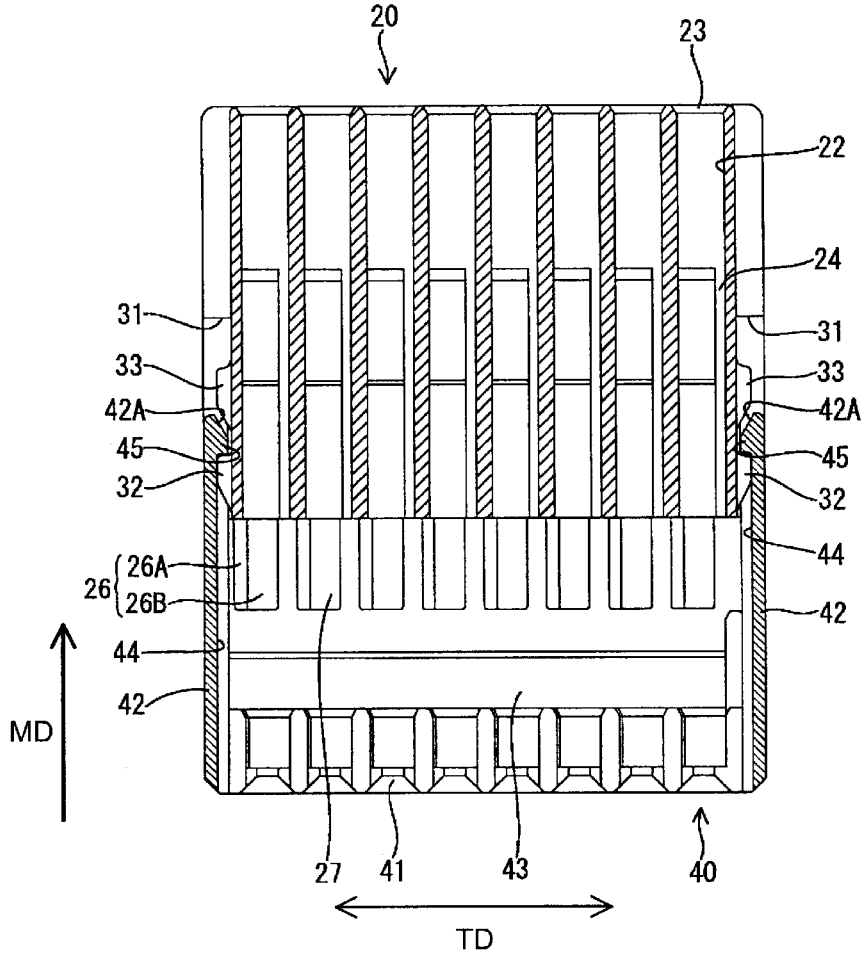
FIG. 8 is a plan view in section showing a state where the retainer is located at a partial locking position.
Figure 9:
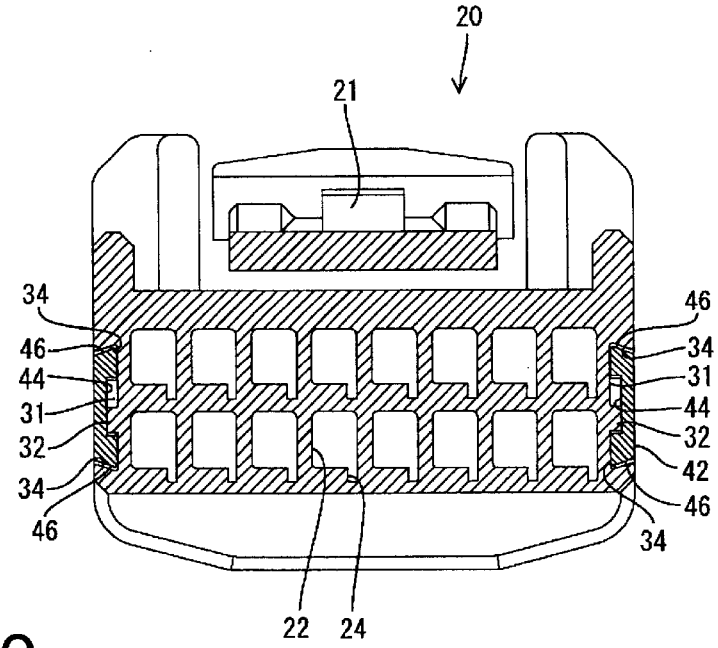
FIG. 9 is a front view in section showing the state of FIG. 8.

When the retainer 40 reaches the partial locking position, the lock projections 45 move beyond the partial locking projections 32, thereby resiliently restoring the side pieces 42 and causing the partial locking projections 32 to enter the recesses 44 to engage the lock projections 45. As a result, the retainer 40 is held at this position (see FIGS. 8 to 10).

Figure 11:
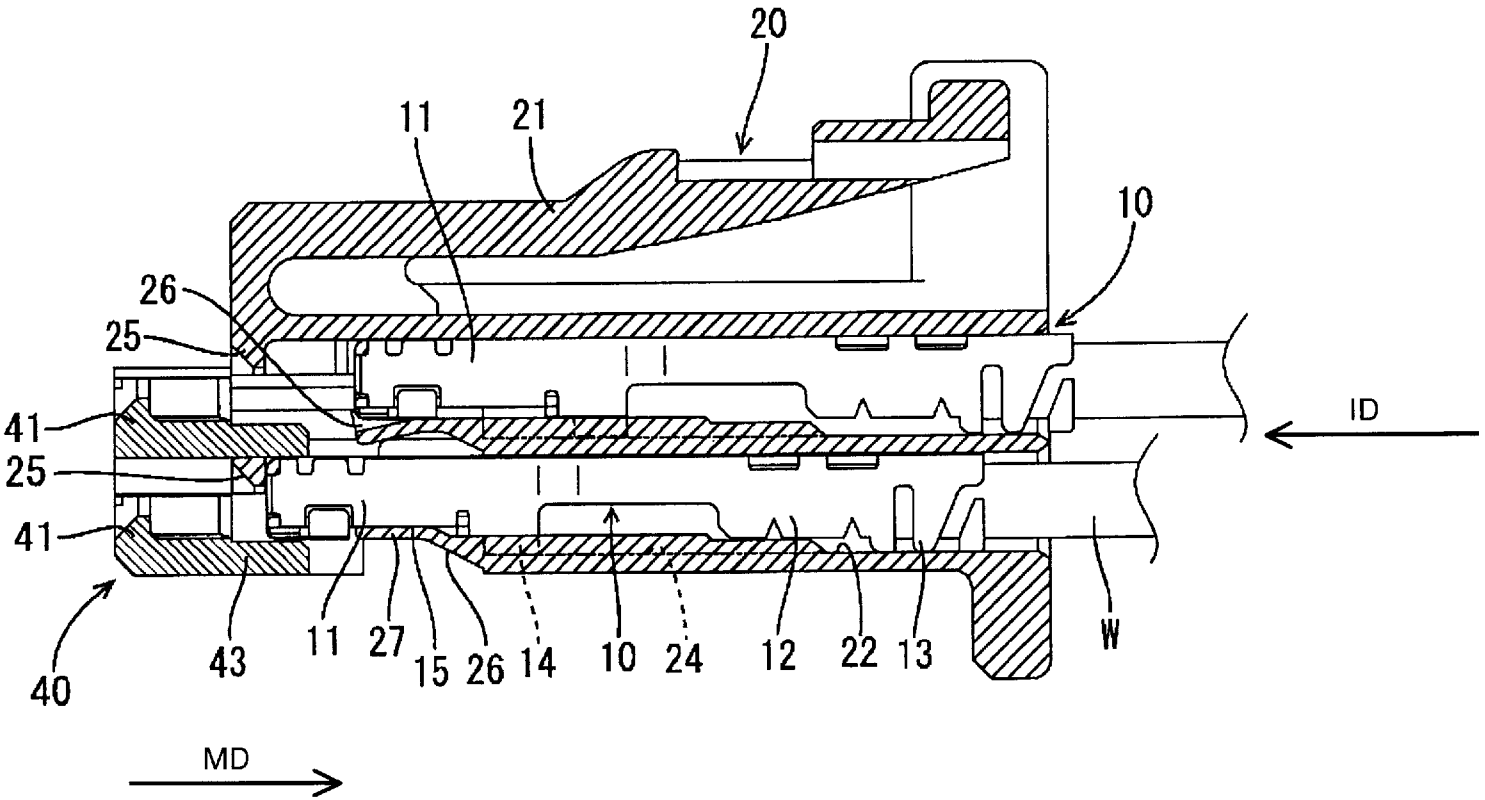
FIG. 11 is a side view in section showing an intermediate stage of mounting a terminal fitting.
Figure 12:
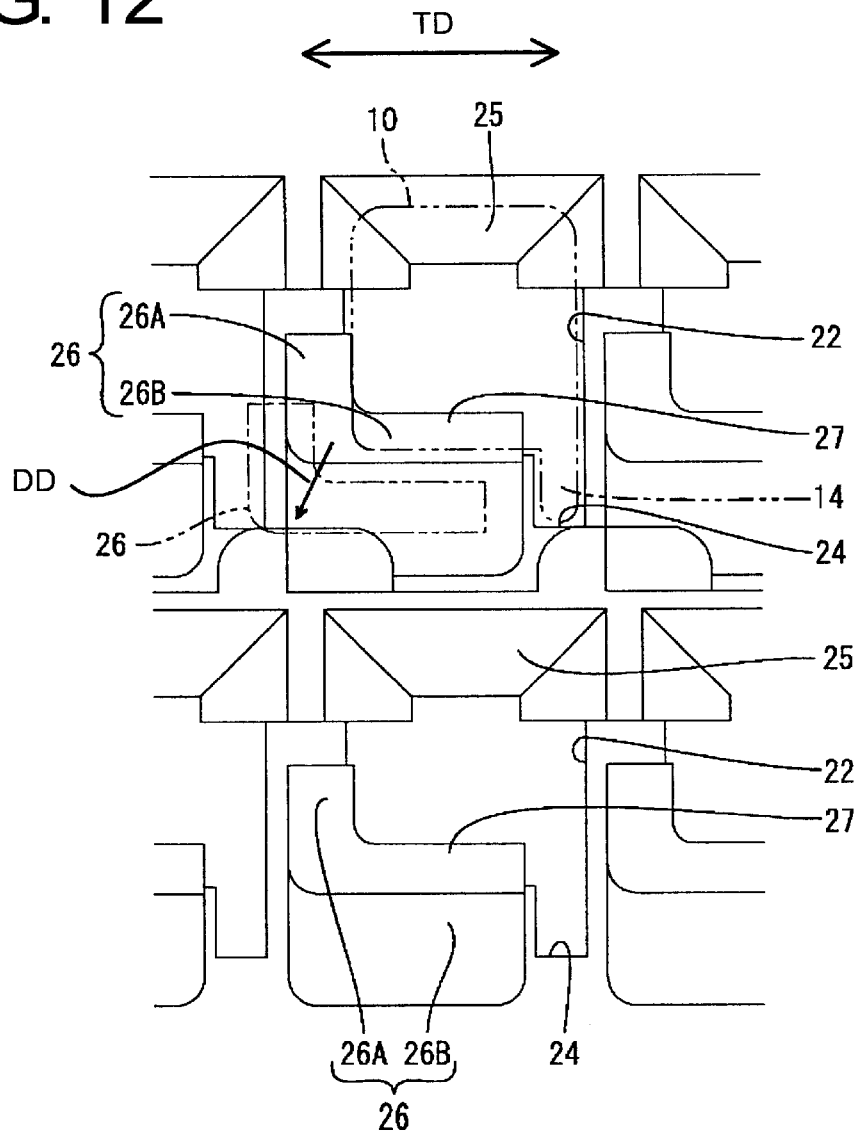
FIG. 12 is a fragmentary enlarged front view of the connector housing showing a movement of a locking portion.

Subsequently, the female terminal fittings 10 are inserted into the respective cavities 22 in the inserting direction ID. When the rectangular tube 11 of the female terminal fitting 10 contacts the locking section 27 of the lock 26, the leading end of the lock 26 is subjected to a downward or laterally acting pushing force. However, since the bottom wall 26B and the side wall 26A form an L-shaped cross section, the leading end of the lock 26 is deformed in the deformation direction DD (a lower-left direction when viewed from the front, as shown by an arrow DD in FIG. 2 and 12, see also the upper cavity 22 of FIG. 11). When the female terminal fitting 10 reaches its proper position where it abuts against the front wall 25, the lock 26 is restored resiliently and the locking section 27 enters the locking recess 15 of the female terminal fitting 10 to lock the terminal fitting 10 as shown in the lower cavity 22 of FIG. 11. In this way, the female terminal fitting 10 is partly locked so as not to come out.

The retainer 40 then is pushed back in the moving direction MD from the partial locking position after the female terminal fittings 10 are inserted into the cavities 22. Thus, the slanted surfaces 42A of the side pieces 42 contact the front surfaces of the full locking projections 33 and, as in the case of the partial locking projections 32, the side pieces 42 resiliently deform in the opening directions to widen the space therebetween and the lock projections 45 move onto the full locking projections 33. In this case as well, the dovetail projections 46 are engaged with the dovetail grooves 34. Thus, the disengagement of the side pieces 42 from the retainer mount recesses 31 can be prevented while allowing a specified deformation of the side pieces 42 needed to pass over the partial and full locking projections 32, 33. When the retainer 40 is pushed further, the lock projections 45 move beyond the full locking projections 33, thereby resiliently restoring the side pieces 42 and engaging the lock projections 45 with the full locking projections 33. Accordingly, the side pieces 42 again undergo a resilient deformation to widen the distance therebetween sufficiently to allow the slanted surfaces 42A to pass over the full locking projections 33 but not more than such specified amount due to the interaction of the dovetail grooves 36 with the dovetail projections 46. As a result, the retainer 40 is held at the full locking position (see FIG. 13). At this time, the deformation preventing portions 43 enter the deformation permitting spaces below the locking sections 27 of the locks 26 to prevent the resilient deformation of the locks 26. As a result, the female terminal fittings 10 are locked doubly. In this way, assembling of the connector is completed.

If an attempt is made to move the retainer 40 to the full locking position with any female terminal fitting 10 mistakenly left insufficiently inserted, any further movement of the retainer 40 is prevented by the contact of the deformation preventing portion 43 with the leading end of the lock 26. Thus, an operator can notice an insufficiently inserted state.

As described above, the open-stopping means, comprised of the dovetail grooves 34 and the dovetail projections 46, is provided between the side pieces 42 of the retainer 40 and the female housing 20. This prevents the side pieces 42 from being resiliently deformed away from each other an amount that would disengage the side pieces 42 from the retainer mount recesses 30, thereby preventing the retainer 40 from being detached from the female connector housing 20 while operating the retainer 40.

Further, the pair of side pieces 42 are prevented from opening and are guided in the mounting direction MD during the movement of the retainer 40 by the engagement of the dovetail projections 46 and the dovetail grooves 34. Thus, the operation can be performed smoothly.

Resilient deformation of the locks 26 is prevented and the retainer 40 at the full locking position locks the terminal fittings 10 doubly.

Each lock 26 has an L-shaped cross section and is deformable in the oblique direction DD. Thus, dimensions of a deformation permitting space along the vertical and horizontal directions of the female housing 20 can be made smaller than an amount of resilient deformation of the lock 26 in its deforming direction. Accordingly, the connector is made smaller by reducing an arrangement interval of the cavities 22 while ensuring sufficient locking forces for locking the terminal fittings 10.

The present invention is not limited to the above described and illustrated embodiment. For example, following embodiments are also embraced by the technical scope of the present invention. Beside the following embodiments, various changes can be made without departing from the scope and spirit of the present invention.

The invention is also applicable to male connectors with male terminal fittings.

A front retainer type retainer in which the terminal fittings are locked doubly by assembling the retainer with the housing from the front to prevent the resilient deformation of the locks is described in the foregoing embodiment. However, the invention also is applicable to side-type retainer connectors in which a retainer is assembled at an angle to the insertion direction of the terminal fittings into the respective cavities to directly lock terminal fittings.

According to the present invention, the open-stopping means may not be particularly provided with a function of guiding the side pieces in their sliding direction.

What is claimed is:

1. A connector, comprising:

a housing having opposite front and rear ends and a plurality of cavities extending between the front and rear ends, terminal fittings being insertable into the cavities in an insertion direction, the housing further having first and second opposite side surfaces and first and second retainer mount recesses formed respectively in the first and second side surfaces, dovetail grooves formed in each of said retainer mount recesses and aligned substantially parallel to the insertion direction, a retainer having first and second retainer pieces fitted respectively into the first and second retainer mount recesses, each of said retainer pieces having dovetail projections engaged respectively with the dovetail grooves of the respective retainer mount recess, the retainer being slidable from a first position where insertion of the terminal fittings into the cavities is permitted to a second position where the terminal fittings are held within the respective cavities, and wherein engagement of the dovetail projections with the dovetail grooves prevents opening deformation of the retainer pieces that would widen a spacing therebetween more than a specified amount.

2. The connector of claim 1, wherein each cavity comprises a resiliently deformable lock including a locking section engageable with the corresponding terminal fitting.

3. The connector of claim 2, wherein the retainer comprises a deformation preventing portion for entering deformation permitting spaces for the locks when the retainer is at the second position to prevent the resilient deformation of the locks.

4. The connector of claim 3, wherein each lock substantially extends along the inserting direction of the terminal fittings and has a substantially L-shaped cross section extending along an arranging direction of the cavities and a direction normal to the arranging direction.

5. The connector of claim 4, wherein the lock is formed to be obliquely deformed when contacting the corresponding terminal fitting.

6. The connector of claim 1, wherein each of the first and second retainer mount recesses is formed with at least one locking projection, and wherein each of the first and second retainer pieces is formed with at least one locking portion for releasable engaging the locking projection in the respective retainer mount recess.

7. The connector of claim 6, wherein the dovetail grooves and the dovetail projections are dimensioned and configured to permit sufficient deflection of the retainer pieces relative to the housing for permitting the locking portions of the retainer pieces to deflect over and onto the locking projections.

8. The connector of claim 7, wherein each of said retainer mount recesses has a partial locking projection and a full locking projection disposed between the partial locking projection and the rear end of the housing, the partial locking projections being for releasably locking the retainer in the first position and the full locking projections being for releasably locking the retainer in the second position.

9. The connector of claim 1, wherein the first and second retainer pieces are substantially flush with portions of the respective first and second side surfaces of the housing adjacent to the respective first and second retainer mount recesses.

10. A connector, comprising:

a housing having a plurality of cavities into which terminal fittings are insertable in an insertion direction and having a pair of retainer mount recesses, a retainer having a pair of retainer pieces fitted respectively into the retainer mount recesses and exposed externally of the housing, the retainer being slidable from a first position where insertion on the terminal fittings into the cavities is permitted to a second position where the terminal fittings are held within the respective cavities, and an open-stopping means between the retainer pieces and the housing for preventing opening deformation of the retainer pieces that would widen a spacing therebetween more than a specified amount.

11. The connector of claim 10, wherein the retainer pieces are substantially flush with external surfaces of the housing having the retainer mount recesses formed therein.

* * * * *